United States Patent [19]

Bell

[11] 3,945,598

[45] Mar. 23, 1976

[54] BOOK HOLDER

[76] Inventor: Robert L. Bell, 170 Warwick Road, Melrose, Mass. 02176

[22] Filed: Aug. 26, 1974

[21] Appl. No.: 500,527

[52] U.S. Cl. ..... 248/441 D
[51] Int. Cl.[2] ..... A47B 19/00
[58] Field of Search ..... 248/441

[56] References Cited

UNITED STATES PATENTS

| | | | |
|---|---|---|---|
| 647,517 | 4/1900 | Pike | 248/453 |
| 1,077,853 | 11/1913 | Osborn | 248/451 |
| 1,242,914 | 10/1917 | Blatt | 248/453 |
| 1,251,006 | 12/1917 | Freundt | 248/453 |
| 1,971,600 | 8/1934 | Denio | 248/453 |

FOREIGN PATENTS OR APPLICATIONS

| | | | |
|---|---|---|---|
| 636,793 | 2/1962 | Canada | 248/451 |

*Primary Examiner*—William H. Schutz
*Attorney, Agent, or Firm*—James E. Mrose

[57] ABSTRACT

A holder for desk-top display of pages of typing books, ring-top shorthand books, and the like, consists of two sturdy wire support elements of identical inverted-V shaping held in laterally-spaced relationship by two additional wire elements joined with legs of the support elements near their lower ends, one of the additional wire elements being of rigid form to receive the bottom edge of a notebook and the other being formed as an elongated spring clip component which cooperates with proximate legs of the support elements to receive and grasp turned-over portions of a supported book, the said lower ends of the support element legs being tipped with relatively soft caps.

1 Claim, 4 Drawing Figures

BOOK HOLDER

BACKGROUND OF THE INVENTION

The present invention relates to improvements in implements for holding typing or shorthand books or the like in position for viewing atop a desk, and, in one particular aspect, to a novel and improved book holder of inexpensive and lightweight open-frame construction which is nevertheless sturdy and stable, the holder consisting mainly of but a few bent wire - or rod-like elements whose form and distribution for cooperative supporting action with portions of books uniquely obviates need for broad-area components.

Racks and stands of various desk-mounted types have of course long been used to hold notebooks, pads, papers and books in erect positions for convenient viewing by typists in the course of transcription during training or in office employment. In some instances, it is desirable that the pages of top-bound materials be held securely after being turned over, and that relatively large and thick typing books or similar items be firmly grasped by the holder, rather than simply being rested in place; such considerations have led to holder designs which function as large spring clips, and the same is true of the construction here disclosed.

Examples of earlier approaches to solutions of book holder problems may be found in U.S. Des. Pat. Nos. 169,903 and 215,767 and 219,757.

Although the prior concepts involving combined stands and clips can be attractively styled in plastic or sheet metal, both of which can be relatively costly and bulky in stable designs, the present improvements are instead based upon use of advantageously simple and readily-fabricated bent rod-like wires (i.e., metal wires which are sufficiently stiff to resist deformation under loading of supported books and yet offer a degree of flexibility which promotes a needed spring-clipping action). These wires are disposed in an open frame array involving no broad-area surfaces, and those portions which cooperate to develop the clip action need not be adjacent one another.

SUMMARY

A preferred desk-top book holder in accordance with the present teachings is fashioned principally of four bent metal wire elements, two of which are of advantageously identical V-shaping and which are inverted to provide four sloping legs the lower ends of which may be capped with soft molded tips serving to prevent marring and slipping in use. The two inverted V-shaped elements are held in spaced parallel relationship by two further wire elements, each of which has its two ends spot-welded to a parallel pair of the sloping legs just above their tipped lower ends. One of the two further wire elements extends forwardly and upwardly, to outline a shallow ledge upon which the lower edge of a stenographer's notebook may be rested, and the other of said elements is of an elongated inverted V shape and inclined upwardly at a slightly greater angle than that of the sloping legs with which it is associated, to define a wedge-type clip with those legs.

Accordingly, it is one of the objects of the present invention to provide novel and improved desk-type book holders of relatively inexpensive and lightweight construction involving but few relatively stiff wire elements in an open-frame construction serving both supporting and spring-clipping functions.

Another object is to provide a unique simple wire-fabricated book holder which is both sturdy and stable and which solidly supports and grasps transcription materials without involving broad-area components.

BRIEF DESCRIPTION OF THE DRAWINGS

Although the aspects and features of this invention which are considered to be novel are expressed in the appended claims, further details as to preferred practices and as to the further objects and features thereof may be most readily comprehended through reference to the following description of preferred embodiments taken in connection with the accompanying drawings, wherein.

DESCRIPTION OF THE PREFERRED EMBODIMENTS

Figure 1:
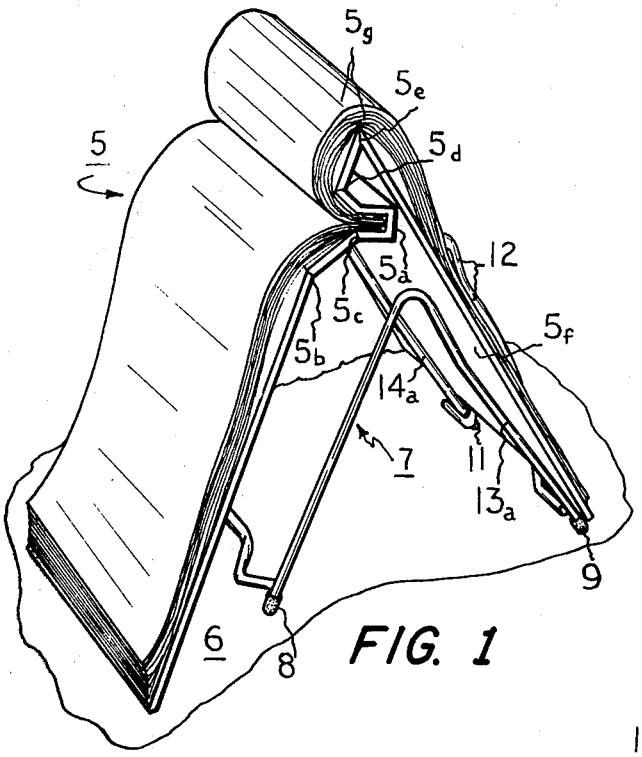
FIG. 1 is a pictorial view of the improved book holder in operative association with a top-bound typing book having turned-over pages spring-clipped in place.
Figure 2:
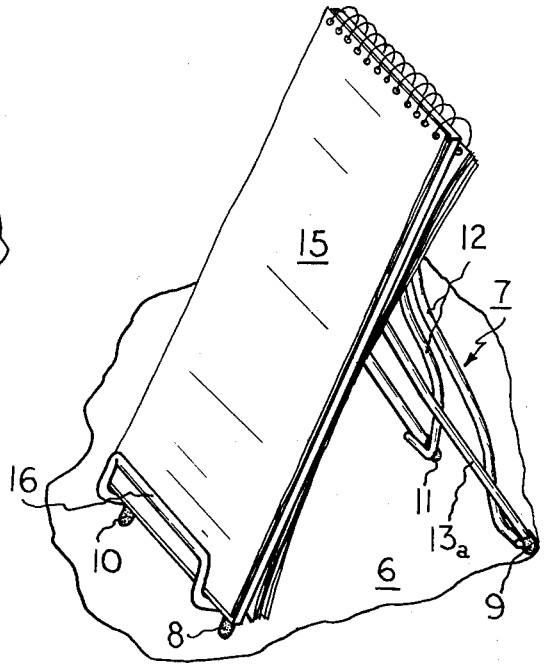
FIG. 2 provides a pictorial view of the same book holder supporting a stenographer's shorthand notebook.
Figure 3:
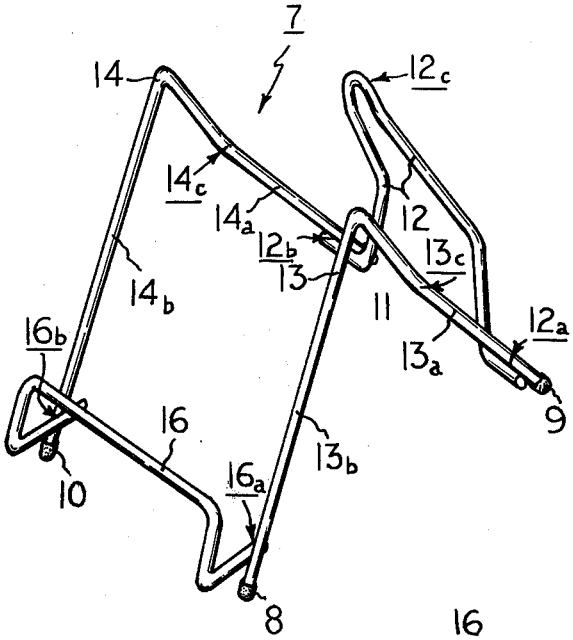
FIG. 3 is a perspective view of the same wire-fabricated book holder alone.
Figure 4:
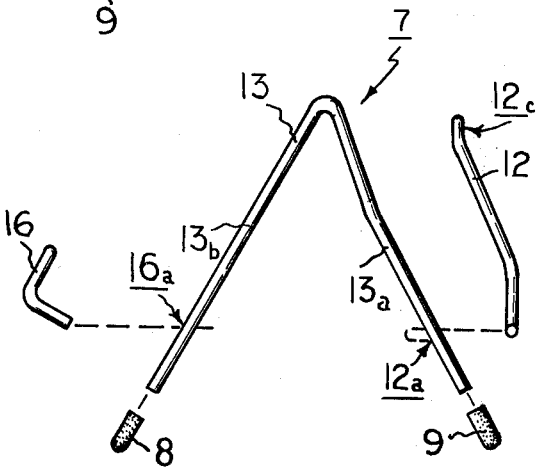
FIG. 4 is a side view of elements of a book holder such as that of FIG. 3, with the elements separated and with dashed linework designating their joined relationships.

The arrangement portrayed in FIG. 1 is one wherein a typing book, 5, of a commonly-used form is supported upon a desk surface 6 by way of a holder 7 whose construction appears more fully in FIGS. 3 and 4. A book of the illustrated type poses a particularly troublesome mounting problem, inasmuch as its overall length dimension is quite large and its holder is preferably of smaller proportions; moreover, the hard-cover top binding 5*a* and hinging creases 5*b*–5*e* promote an unwanted tendency for the displayed pages to turn or flip over by themselves. Accordingly, although holder 7 is made as a relatively low-height item, it is also made stable enough to grasp and sustain the bulk of book 5 without relying upon significant auxiliary support through the book itself. In that connection, it should be noted that holder 7 has four well-spaced points of support upon the desk surface, through its soft leg tips 8–11, and that it serves to clip and hold one of the hard covers, 5*f*, and turned-over pages, 5*g*, between cooperating frame parts 12 and 13*a* and 14*a*. In another use, such as mounting of a ring-bound shorthand notebook 15 in the manner represented in FIG. 2, the holder simply carries the lower edge of the notebook in a shallow front tray element, 16, and the notebook will rest rearwardly against rearwardly-sloping frame parts 13*b* and 14*b* (FIGS. 3 and 4).

Holder 7 is preferably fabricated mainly of rod-like metal wire stock, such as steel, which is stiff enough to retain the desired bent forms under loading and which also has a desired degree of resilience enabling the back part 12 to flex slightly as a spring clip. Two of the wire members, 13 and 14, are identical in size and shaping, and have the general shaping of inverted V's, although their rear leg portions 13*a* and 14*a* are preferably bent inwardly slightly, at 13*c* and 14*c*, to promote insertions of book covers and pages between those leg portions and the cooperating clip member 12. Members 13 and 14 form the two sides of the holder, as well as defining a rearwardly-sloping plane of support, via forward legs 13*b* and 14*b*, and a forwardly-sloping plane of support, via the two rear legs 13*a* and 14*a*. Lateral spacing and parallelism between the planes of side members 13 and 14 are maintained by the front tray-defining wire member 16 and by the rear clip-defining wire member 12; in both instances, the ends of the latter members are united with the adjoining legs, as by spot welds at 16*a* and 16*b*, and at 12*a* and 12*b*, respectively. The sites of these welds are just above the lower ends of legs 13*a*, 13*b*, 14*a* and 14*b*, such that those ends remain exposed to receive small tips or caps 8–11, the latter being of somewhat soft plastic or rubber, to insure that the holder will not inadvertently slide or skid across a desk surface or mar the same.

Clip member 12 extends upwardly and forwardly, as shown, preferably at a slightly greater angle than that defined by the rear legs 13*a* and 14*a*, for purposes of admitting a cover and turned-over pages of a book in the manner portrayed in FIG. 1. Member 12 is generally V-shaped, also, and its apex portion 12*c* is preferably bent slightly rearwardly (FIG. 4) to facilitate the insertions and to facilitate its manual spring-deflection rearwardly. Although neither the legs 13*a* and 14*a* nor clip member 12 are themselves of broad area, their combination nevertheless develops the desired spring-clipping action in relation to relatively stiff materials inserted between them.

Those skilled in the art will appreciate that certain modifications may be effected within the scope of this invention. By way of example, use of somewhat thinner wire stock may make it desirable to augment structural strength through addition of bracing members, between and/or across the legs of members, 13 and 14. Further, the illustrated shapings of the various members may be changed so long as their functions are retained. Accordingly, it should be understood that the specific preferred embodiment and practices described herein have been presented by way of disclosure rather than limitation, and that certain departures may be accommodated within the spirit and scope of this invention in its broader aspects and as set forth in the accompanying claims.

What I claim as new and desire to secure by Letters Patent of the United States is:

1. A desk-type book holder comprising a pair of substantially identical inverted-V shaped side members of relatively stiff metal wire, and a pair of transversely-extending support members of relatively stiff metal wire each fixed at its ends with lower end portions of a different pair of the legs of said side members, said support members maintaining the planes of said side members in substantially parallel spaced relationship, whereby said book holder has two parallelly spaced front legs and a pair of parallelly spaced rear legs, one of said support members extending forwardly from the front legs and then upwardly to define a tray for receipt of the lower edge of a book in one use of the holder, the other of said wire support members comprising a spring clip of elongated V-shape with the free ends of the clip secured to the rear legs adjacent the ends thereof, said clip being equidistantly positioned between the rear legs and with its apex extending at least half way up the length of the rear legs, the lower portion of the clip extending upwardly and rearwardly with respect to the rear legs so that a wedge-shaped space is formed between the plane of the rear legs and that of the lower portion of the clip, the remaining portion of the clip extending upwardly and forwardly with respect to the plane of the lower clip portion whereby when a hard-cover book is carried by said holder the turned over pages and hard-cover book back will be held in position between a gripping plane formed by the rear legs and a spring gripping surface formed by the clip.

* * * * *